United States Patent [19]

Obata et al.

[11] Patent Number: 5,029,458

[45] Date of Patent: Jul. 9, 1991

[54] FULL-AUTOMATIC WASHING AND DRYING MACHINE

[75] Inventors: Yukio Obata; Hitoshi Ogasahara, both of Yokohama, Japan

[73] Assignee: Hitachi, Ltd., Tokyo, Japan

[21] Appl. No.: 524,582

[22] Filed: May 17, 1990

[30] Foreign Application Priority Data

May 20, 1989 [JP] Japan ..... 1-127551

[51] Int. Cl.[5] ..... D06F 23/02; D06F 25/00

[52] U.S. Cl. ..... 68/19.2; 68/20; 68/23.1; 68/24; 68/207; 68/208

[58] Field of Search ..... 68/19.2, 20, 23.1, 24, 68/207, 208

[56] References Cited

U.S. PATENT DOCUMENTS

| | | | |
|---|---|---|---|
| 2,660,870 | 12/1953 | Kennedy | 68/24 |
| 2,777,313 | 1/1957 | Dodge | 68/20 |
| 3,006,176 | 10/1961 | Behrens | 68/19.2 X |
| 3,106,832 | 10/1963 | Bochan | 68/20 |
| 3,172,277 | 3/1965 | Burkland | 68/24 X |
| 3,349,579 | 10/1967 | Geschka et al. | 68/19.2 X |
| 4,856,301 | 8/1989 | Broadbent | 68/24 X |

FOREIGN PATENT DOCUMENTS

| | | | |
|---|---|---|---|
| 230071 | 4/1959 | Australia | 68/20 |
| 2044297 | 10/1980 | United Kingdom | 68/20 |

*Primary Examiner*—Philip R. Coe

*Attorney, Agent, or Firm*—Antonelli, Terry, Stout & Kraus

[57] ABSTRACT

A full-automatic washing and drying machine has a drum mounted in an outer tank for rotation about a substantially horizontal axis, a reversible motor operable at a fixed speed for driving the drum, and a power transmission device for transmitting the torque of the motor to the drum axle. The power transmission means include a reduction device. The motor and the reduction device are controlled by a control device such that, during washing and drying operations, the direction of rotation of an output shaft of the motor is switched in short periods while the speed-changing device transmits the rotation of the output shaft of the motor to the drum axle at a reduced speed, whereas, during dehydration operation, the motor operates unidirectionally and the speed-changing device transmits the unidirectional rotation of the motor output shaft to the drum axle with a speed reduction in an initial stage of the dehydration operation and, thereafter, without speed reduction.

15 Claims, 7 Drawing Sheets

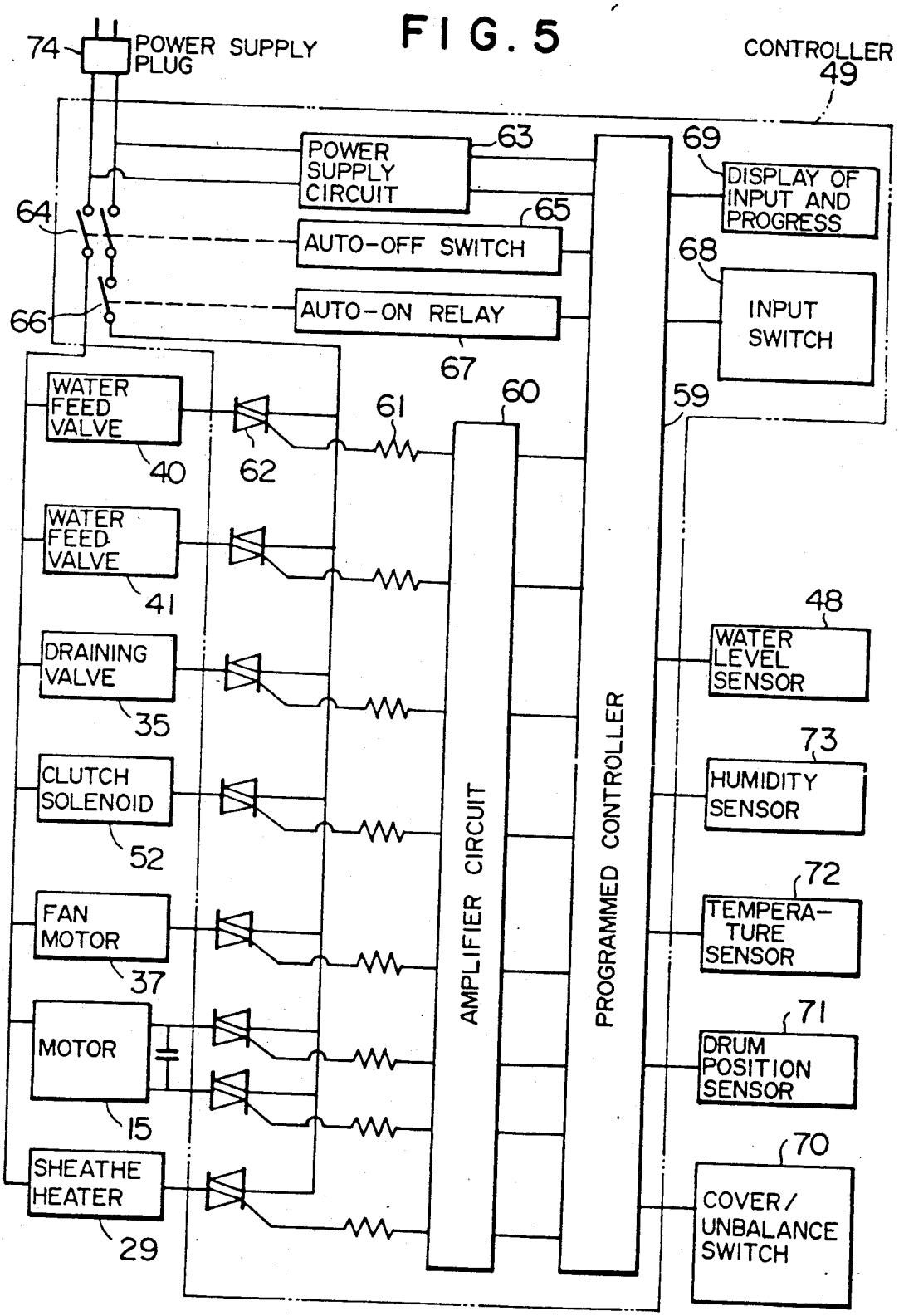
FIG. 5
74
POWER SUPPLY PLUG
CONTROLLER
49
POWER SUPPLY CIRCUIT
63
69
DISPLAY OF INPUT AND PROGRESS
64
AUTO-OFF SWITCH
65
68
INPUT SWITCH
66
AUTO-ON RELAY
67
WATER FEED VALVE
40
62
61
60
59
WATER FEED VALVE
41
48
WATER LEVEL SENSOR
DRAINING VALVE
35
73
HUMIDITY SENSOR
CLUTCH SOLENOID
52
72
TEMPERA-TURE SENSOR
FAN MOTOR
37
71
DRUM POSITION SENSOR
MOTOR
15
70
SHEATHE HEATER
29
COVER/ UNBALANCE SWITCH
AMPLIFIER CIRCUIT
PROGRAMMED CONTROLLER

FULL-AUTOMATIC WASHING AND DRYING MACHINE

BACKGROUND OF THE INVENTION

The present invention relates to a full-automatic washing and drying machine which automatically performs a series of operations including washing, rinsing, dehydration and drying. More particularly, the invention relates to a full-automatic washing and drying machine of drum type.

DESCRIPTION OF THE RELATED ART

A full-automatic washing and drying machine capable of automatically washing and drying clothes or the like is disclosed in, for example, Japanese Patent Unexamined Publication No. 56-5964. This known washing and drying machine has a drum which is rotatable about a horizontal axis and which plays triple roles of a washing drum, a dehydration drum and a drying vessel. During the washing, the drum is rotated at a low speed, e.g., 50 rpm, so that clothes in the drum are repeatedly lifted by lifters provided on the inner peripheral surface of the drum and them caused to fall so as to be cleaned. During the dehydration, the drum is rotated at a high speed, e.g., 600 to 1,100 rpm, so that water is extracted by centrifugal force. During the drying, hot air heated by a heater or the like is introduced into the drum while the drum is rotated at a low speed, e.g., 50 rpm, and the air moistened by water evaporated from the clothes is discharged outside the drum, thus promoting the drying.

Japanese Patent Unexamined Publication No. 55-78996, for example, discloses a full-automatic washing and drying machine in which cold water is sprayed to the moistened air discharged from the drum during drying so as to positively cool the moistened air to condense the water content to lower the absolute humidity of the air. The air thus dried is then heated by a heater, e.g., an electrically insulated sheathe heater, and then introduced again into the drum.

In general, these known drum-type full-automatic washing and drying machines suffer from the following problems:

(1) The cleaning power of this type of machine is small as compared with those of other types of machines such as a whire-type machine in which a rotary blade provided on the bottom of a washing tank is rotated and a stirring-type machine in which stirring blade provided at the center of a washing tank is reciprocally rotated.

As explained before, the cleaning effect of the drum-type washing machine relies upon an impact force exerted to the clothes which is produced when the clothes fall after lifted by lifters provided on the inner peripheral surface of the drum. This impact force and, hence, the cleaning effect are not so strong, so that measures are taken in this type of machine such as the use of warm water for promoting cleaning and an increase of the drum diameter to enhance the impact force.

The use of warm water undesirably raises the running cost of the machine, while the use of a drum having a large diameter raises the levels of noise and vibration during dehydration due to uneven distribution of the mass of the clothes. The drum of a large diameter also increases the size of the machine, in particular height and depth or width.

(2) In the full-automatic drum type washing and drying machine, the drum is rotated at about 50 rpm during both washing and drying modes and at about 600 to 1,000 rpm during dehydration. In order to rotate the drum at such a high speed, it is necessary to transmit a large torque to the drum because the clothes which contain a large amount of water are concentrated to the lower region of the drum after the washing. To cope with this demand, it has been necessary to employ a combination of a speed-changeable motor and a reduction gear having a large reduction ratio.

The speed-changeable motor is expensive as compared with the conventional 4-pole capacitance-type induction motor which is ordinarily use din whirl-type and stirring type washing machines. The cost is further raised due to provision of a speed-changing controller.

SUMMARY OF THE INVENTION

Accordingly, an object of the present invention is to provide a full-automatic washing and drying machine which is improved in both washing and drying performances and which achieves reductions both in cost and size, thereby overcoming the above-described problems of the known arts.

The full-automatic washing and drying machine according to the present invention includes a machine frame, an outer tank supported by the machine frame, vibration damping means disposed between the machine frame and the outer tank so as to damp vibration of the machine frame and a drum mounted in the outer tank for rotation about a substantially horizontal axis and accommodating an object to be washed and dried during washing, dehydration and drying. The drum has a cylindrical portion provided with an entrance opening which can be closed, end walls closing both axial ends of the cylindrical portion, and at least one drum axle fixed to one of the end walls and arranged coaxially with the substantially horizontal axis, the drum axle being rotatably supported by the outer tank.

The machine further includes a reversible motor operable at a fixed speed and power transmission means for transmitting the torque of the motor to the drum axle. The power transmission means includes speed-changing means having an input shaft driven by the motor and an output shaft drivingly connected to the drum axle.

The machine further includes control means for controlling the motor and the speed-changing means such that, during washing and drying operations, the direction of rotation of an output shaft of the motor is cyclically switched in short periods while the speed-changing means transmit the rotation of the output shaft of the motor to the drum axle at a reduced speed, whereas, during a dehydration operation, the motor operates unidirectionally and the speed-changing means transmit the unidirectional rotation of the motor output shaft to the drum axle with a speed reduction in an initial stage of the dehydration operation and without speed reduction in the later stage of the dehydration operation.

The machine further includes water feeding means for supplying water at least into the interior of the drum prior to the washing operation, draining means for draining the interior of the drum during the dehydration operation, and drying means including hot air supplying means for supplying hot air into the drum during the drying operation.

Thus, the full-automatic washing and drying machine of the present invention has the reversible motor operable at a fixed speed, and the transmission means for transmitting the torque of the motor to the drum axle and having speed-changing means. The motor and the speed-changing means are controlled by the controller such that, during washing and drying operations, the direction of rotation of an output shaft of the motor is cyclically switched in short periods while the speed-changing means transmit the rotation of the output shaft of the motor to the drum axle at a reduced speed, whereas, during a dehydration operation, the motor operates unidirectionally and the speed-changing means transmit the unidirectional rotation of the motor output shaft to the drum axle with a speed reduction in an initial stage of the dehydration operation and, without speed reduction in a later stage of dehydration operation.

Thus, the change-over between the mode in which the drum is repeatedly and reciprocatingly rotated for washing and drying and the mode in which the drum is unidirectionally rotated at low and high speeds for dehydration can be achieved by the combination of inexpensive reversible motor and the speed-changing means, without requiring expensive speed-changeable motor. Furthermore, the low-speed unidirectional rotation of the drum in the initial stage of the dehydration enables an initial water extraction to be conducted with a light load, thus enabling a small and inexpensive motor to be used for dehydration.

The above and other objects, features and advantages of the present invention will become more apparent from the following description of the preferred embodiments with reference to the accompanying drawings.

BRIEF DESCRIPTION OF THE DRAWINGS

FIG. 5 is a block circuit diagram of a control device denoted by numeral 49 in FIGS. 2 and 3;

DESCRIPTION OF THE PREFERRED EMBODIMENTS

Preferred embodiments of the present invention will be described with reference to the drawings.

Figure 1:
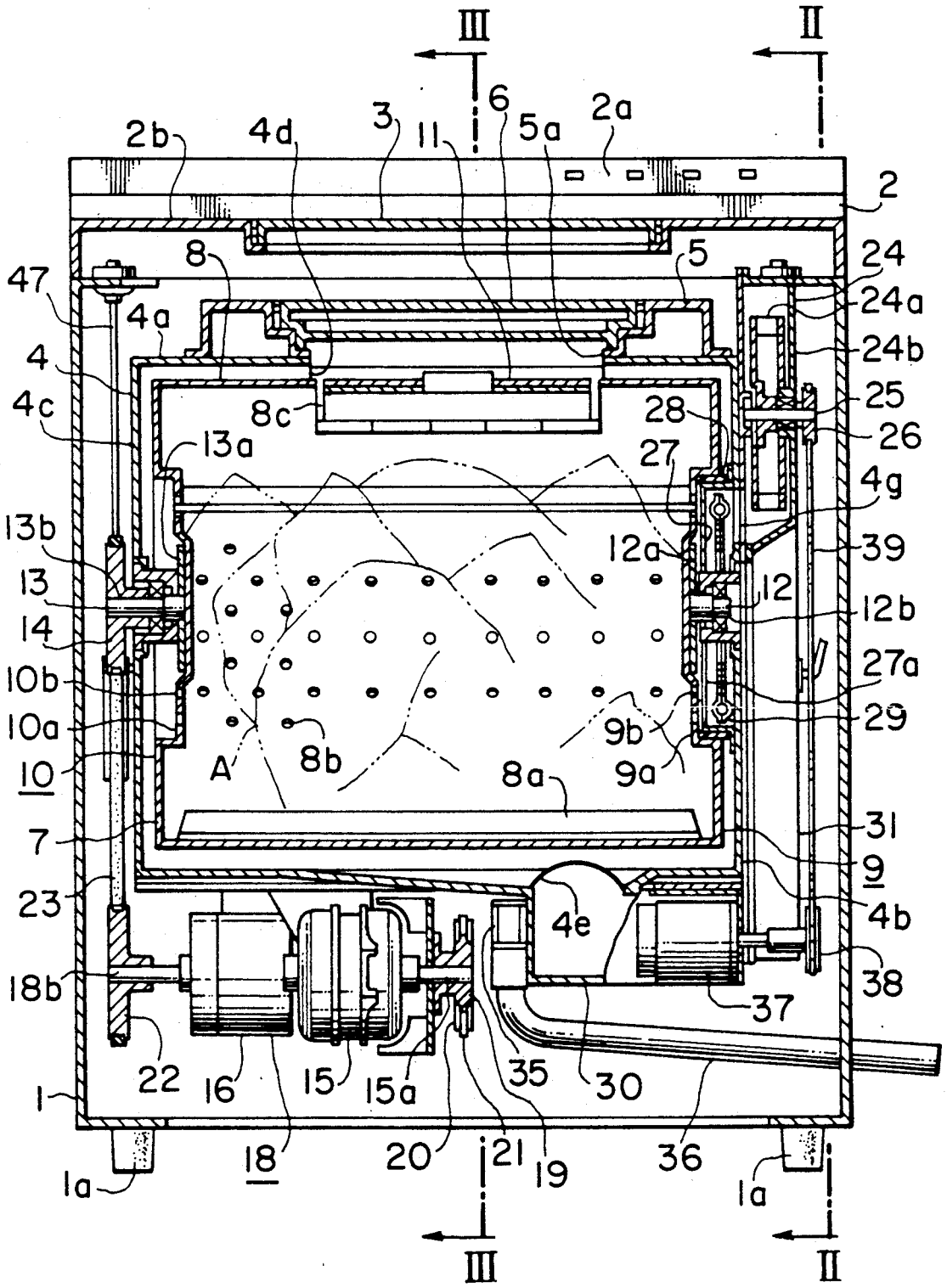
FIG. 1 is a vertical sectional view of an embodiment of a full-automatic washing and drying machine in accordance with the present invention.
Figure 2:
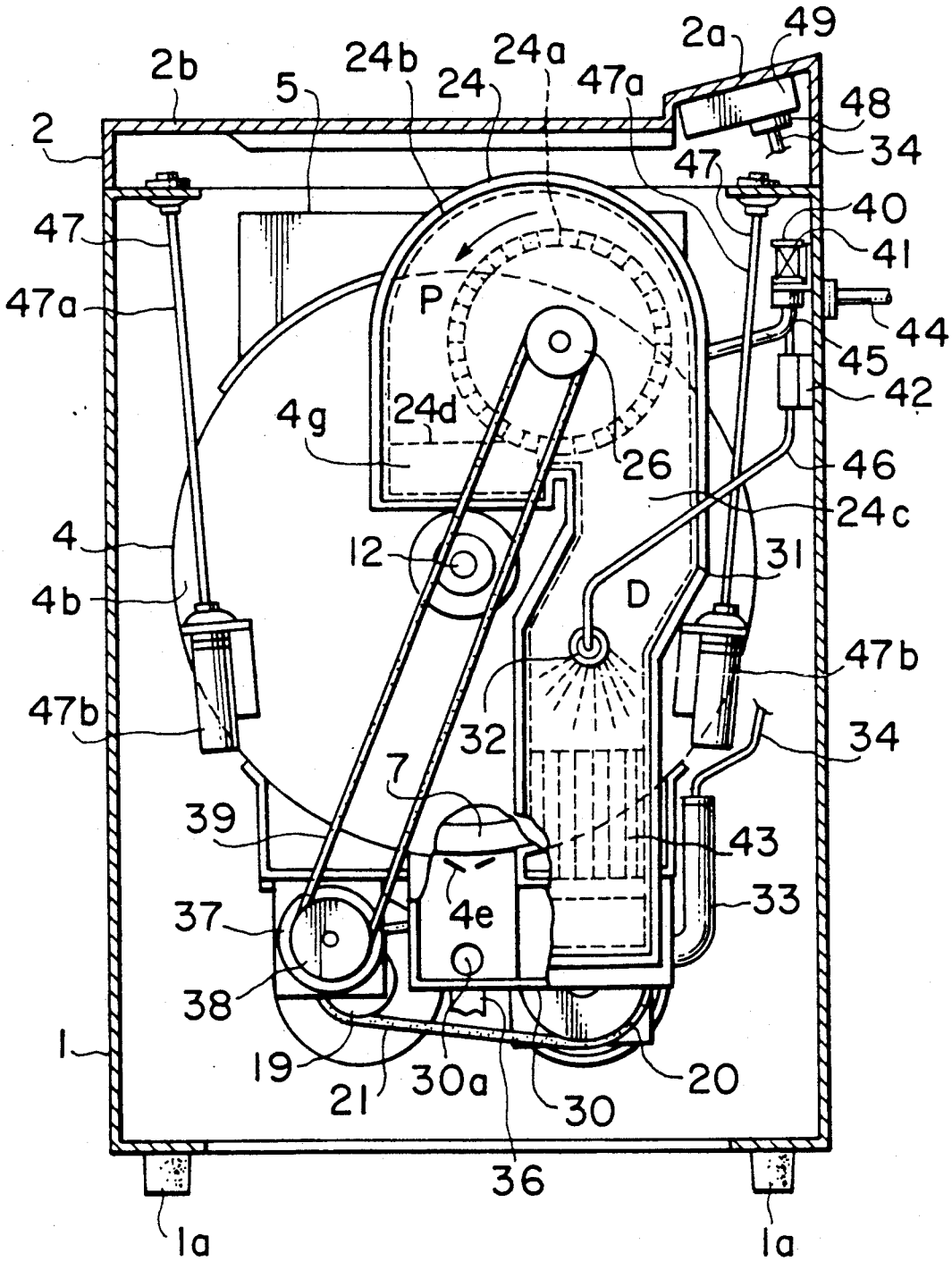
FIG. 2 is a sectional view taken along the line II—II in FIG. 1.
Figure 3:
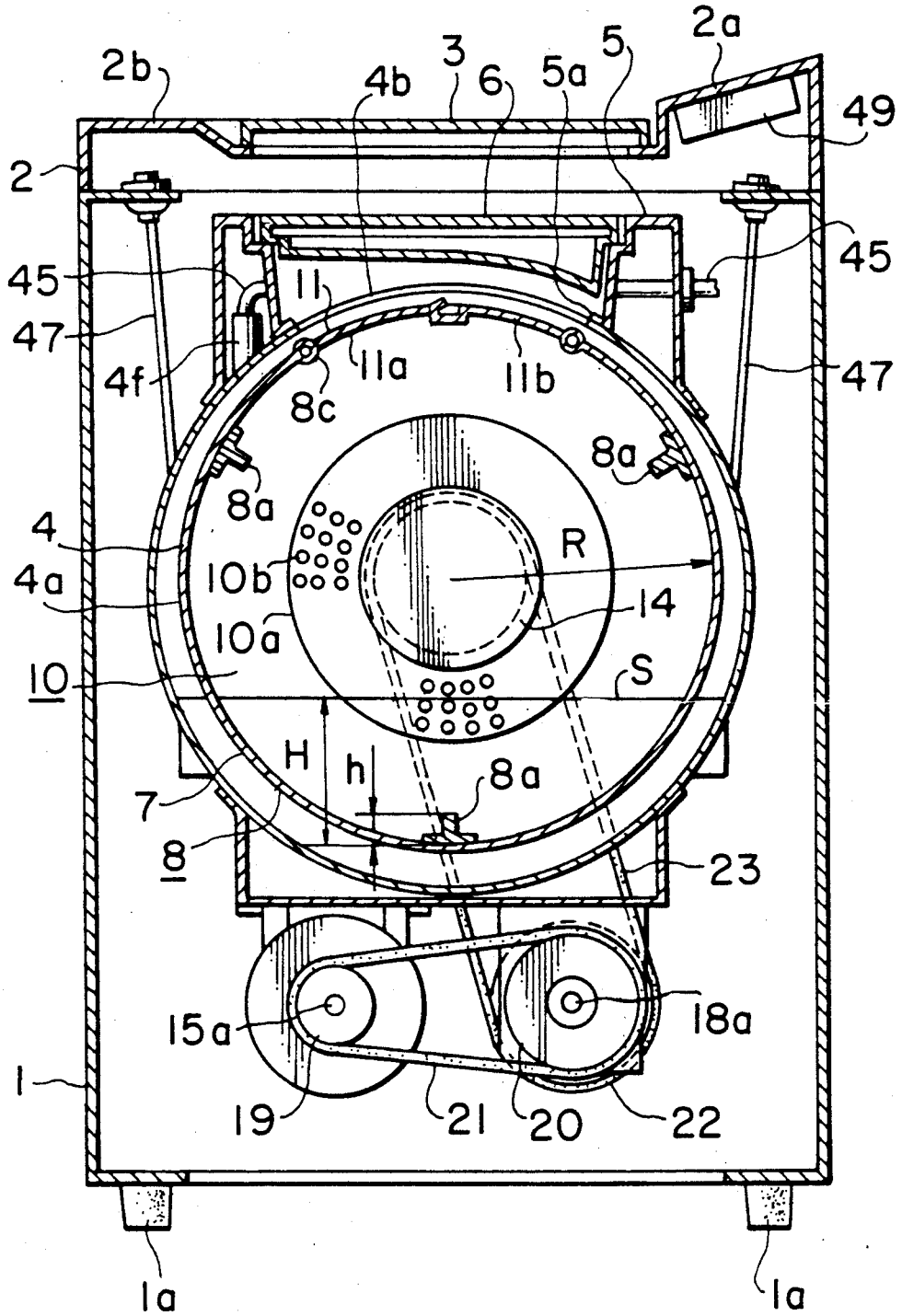
FIG. 3 is a sectional view taken along the line III—III in FIG. 1.

Referring to FIGS. 1 to 3, an outer frame 1 of a full-automatic washing and drying machine is supported by rubber members 1*a*. A top cover 2 is fixed to the outer frame 1 and formed by a control panel portion 2*a* covering a control device 49 and a cover portion 2*b* integrated with the control panel portion 2*a*. A lid 3 is screwed to the cover portion 2*b*. An outer tank 4 is formed by a cylindrical portion 4*a* and end plates 4*b* and 4*c*. The outer tank 4 has an opening 4*d* formed in the upper portion of the cylindrical portion 4*a* to enable clothes to be put into and out of the cylindrical portion 4*a*, a draining opening 4*e* formed in the lower end portion of the cylindrical portion 4*a*, and a water filling opening 4*f* (see FIG. 3) provided in an upper portion of the cylindrical portion 4*a*. The outer tank 4 also is provided with an opening 4*g* formed in the center portion of the end plate 4*b*. During operation of the machine in a drying mode, air is introduced into a later-mentioned drum 7 through this opening 4*g*. The outer tank 4 receives the drum 7. The drum 7 is rotatably supported at its opposite axial ends on central portions of both end plates 4*b* and 4*c* of the outer tank 4. The drum 7 is capable of holding washing water and rinsing water during washing and rinsing operations of the machine. A tank cover 5 is fixed to the outer tank 4 and has an opening 5*a* which is aligned with the opening 4*d* formed in the upper part of the cylindrical portion 4*a* of the outer tank 4. An outer tank lid 6 is fixed to the outer tank cover 5.

The drum 7 is generally about 380 to 440 mm in diameter, serves as a washing vessel and a dehydration vessel and functions also as a drying vessel during drying. The drum 7 has a cylindrical portion 8 and end plates 9 and 10. As will be best seen from FIG. 3, a plurality of lifters 8*a* are provided on the inner peripheral surface of the drum 7 at a constant circumferential pitch and project radially inwardly. During rotation of the drum 7 in the washing and drying modes, these lifters 8*a* lift the clothes A to impart mechanical impact and to stirr the clothes A so as to promote cleaning and drying. The cylindrical wall of the drum 7 is perforated to have a multiplicity of apertures 8*b* of 4 to 6 mm in diameter serving as dehydration apertures and humidified air discharge apertures in the dehydration and drying operations of the machine, respectively. These apertures 8*b* are arranged coarsely at one axial end region adjacent the air inlet and densely at the opposite axial end region and disposed over the entire circumference of the drum 7. A portion of the cylindrical wall of the drum 7 is cut away to form an entrance opening 8*c*. The drum wall defining the entrance opening 8*c* is provided with a pivotable drum lid 11 to be discussed later.

The central part of the end plate 9 of the drum 7 adjacent the hot-air inlet is recessed as at 9*a* to project inwardly of the drum 7. A multiplicity of small holes 9*b* forming passages for the hot air are formed in the outer peripheral portion of the flat circular portion of the recess 9*a*. The outer end plate 10 opposing the end plate 9 has the same shape as the end plate 9. Namely, it has a central recess 10*a* and a multiplicity of small holes 10*b* for discharging moistened air from the interior of the drum 7.

The drum lid 11 is composed of a front lid 11*a* and a rear rid 11*b*. A first shaft portion 12 is composed of a hub 12*a* fixed to the end plate 9 of the drum 7 and a journal portion 12*b* integrated with the hub 12*a*, while a second shaft portion 13 includes a hub 13*a* fixed to the end plate 10 of the drum 7 and a journal portion 13*b* integral with the hub 13*a* and carrying a drum-driving pulley 14 fixed thereto.

A four-pole capacitance type induction motor 15 cooperates with a later-mentioned reduction device 16 and with a later-mentioned belt transmission device to form a drive unit for driving the drum 7. The motor 15 is fixed to a lower portion of the outer tank 4. During the washing and drying operations of the machine, the drive unit reciprocating rotatably drives the drum 7 through a later-mentioned reduction mechanism 18 at a frequency of 10 to 30 cycles per minute, each cycle including 0.5 to 2.5 turns of forward rotation, 0.3 to 2.0 seconds of pause (power supply to motor is cut-off), 0.5 to 2.5 turns of backward rotation and 0.3 to 2.0 seconds of pause. In the beginning stage of the dehydration of the machine, the drum 7 is drive through the reduction mechanism 18 at a low speed, e.g., 80 to 120 rpm. Then, a later-mentioned clutch mechanism 17 in the reduction device 16 is brought into torque transmitting condition so that the drum is rotated at a high speed, e.g., 600 to 1,000 rpm.

Figure 4:
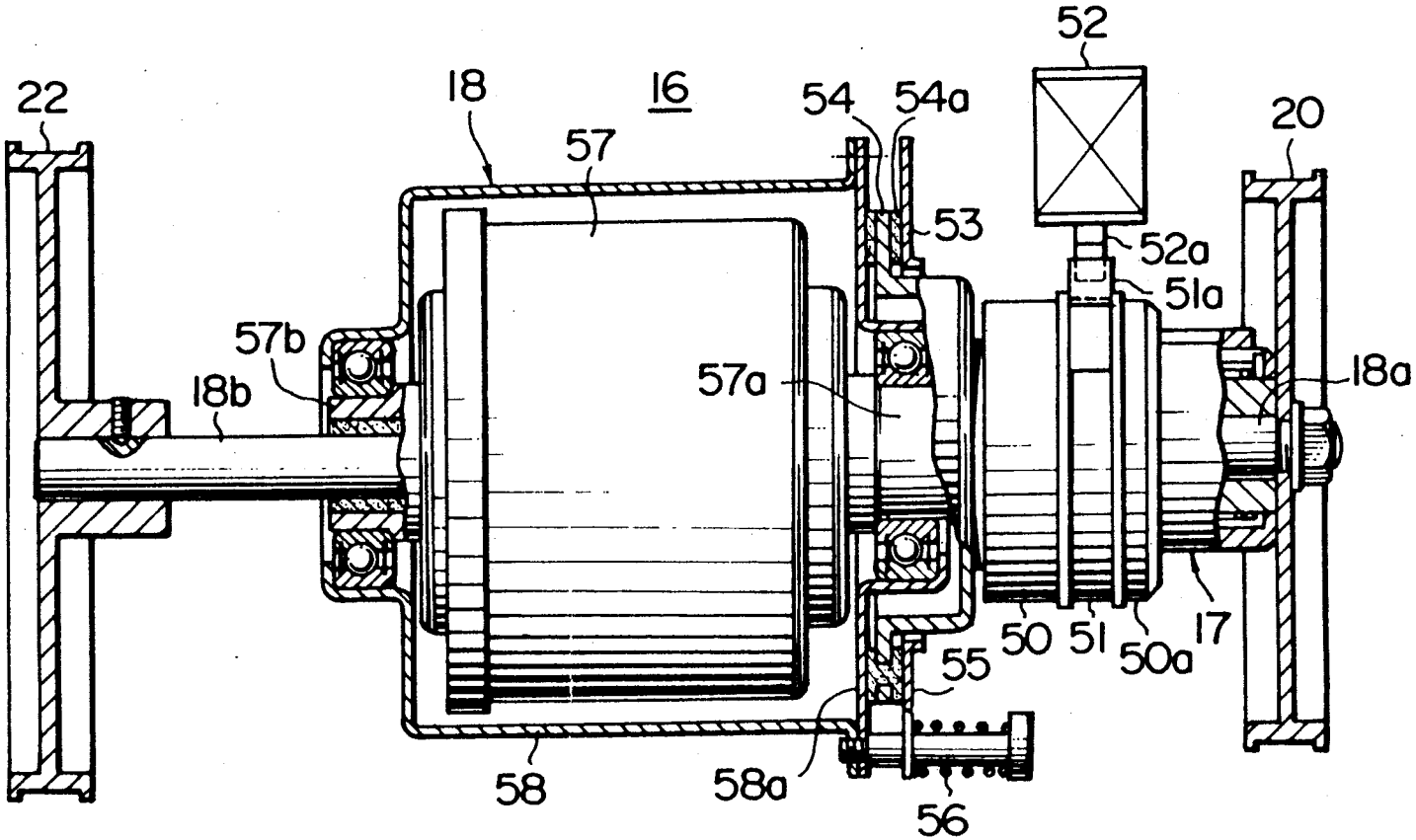
FIG. 4 is an enlarged front sectional view of a reduction device denoted by numeral 16 in FIGS. 1 to 3.

Thus, the reduction device 16 incorporates the clutch mechanism 17 which will be described later with reference to FIG. 4 and the reduction mechanism 18. The reduction device 16 is fixed to a lower portion of the outer tank 4 as is the motor 15.

A belt 21 extends between and around a pulley 19 fixed to the shaft 15*a* of the motor 15 and a pulley 20 fixed to an input shaft 18*a* of the reduction mechanism 18. The pulleys 19 and 20 and the belt 21 in cooperation form a first belt transmission mechanism. In order to reduce wear and noise of gears in the clutch mechanism 17 and the reduction mechanism 18 of the reduction device 16 and in order to attain a high drum rotation speed during dehydration, the pulley 20 has a greater diameter than the pulley 19 so that the torque of the motor 15 is transmitted to the input shaft 18*a* of the reduction mechanism 18 at a reduced speed. A belt 23 extends between and around a pulley 22 fixed to an output shaft 18*b* of the reduction device 16 and the aforementioned drum driving pulley 14. The pulley 22 has the same diameter as the pulley 14. The pulleys 22 and 14 and the belt 23 in cooperation form a second belt transmission mechanism.

A flat-type through-flow circulation fan 24 has an impeller 24*a* and a casing 24*b* which is divided into left and right parts along a plane including the axis of the impeller 24*a*. A suction opening 24*c* and a discharge opening 24*d* are provided on the same side of the fan 24. The fan 24 is fixed to an upper portion of the end plate 4*b* of the outer tank 4 and supplies hot air into the drum 7 so as to circulate air through the drum 7. The impeller 24*a* of the fan 24 has a shaft 25 which is rotatably supported on the front and rear end plates of the casing 24*b*. A pulley 26 is fixed to the fan shaft 25.

A heating chamber 27 is fixed to the inner surface of the end plate 4*b* of the outer tank 4 at the center of the end plate 4*b*. The heating chamber 27 hermetically fits in the recessed portion 9*a* of the end plate 9 of the drum 7 and is provided in its lower half portion with an opening 27*a* for introducing heated air into the drum 7. A ring-shaped sealing member 28 is fixed to the wall of the heating chamber 27 and pressed between this wall and the peripheral wall of the recessed portion 9*a* of the end plate 9. The sealing member 28 is preferably made of a heat-resistant and self-lubricating material such as a fluororesin. A plurality of sheath heater elements 29, having conductors electrically insulated from their surfaces, are disposed in the heating chamber 27 for the purpose of heating moistened air which is circulated in the drying operation of the machine. In order to increase the area of contact with the air, a plurality of ring-shaped fin members with a multiplicity of holes therein are attached to the sheath of each sheath heater elements.

A draining chamber 30 is defined by a member fixed to a lower portion of the outer tank 4. The draining chamber communicates with the aforementioned draining opening 4*e* formed in the bottom of the outer tank 4. The wall of the draining chamber 30 has a draining hole 30*a* leading to a later-mentioned draining valve 35, a hole to be connected to a later-mentioned trap 33 and a portion to be connected to a later-mentioned duct 31. The duct 31 rises from the draining chamber 30 and is connected to the suction opening 24*c* of the circulation fan 24. A shower-type or aromizer-type water sprayer 32 is disposed in an intermediate portion of the duct 31 so as to spray water downwards. The water sprayer 32 is connected to a later-mentioned water feed valve 41.

The afore-mentioned trap 33 is connected through a flexible tube 34 of a small diameter to a water level sensor 48 so as to transmit a water heat corresponding to the water level in the outer tank 4 to the water level sensor 48. The draining valve 35 connected to the draining hole 30*a* of the draining chamber 30 is a solenoid-actuated valve to which a draining hose 36 is connected.

The circulation fan 24 is driven by a fan motor 37 fixed to the underside of the outer tank 4, through a fan-drive belt transmission device including a pulley 38 fixed to the shaft of the fan motor 37, the aforementioned pulley 26 on the fan shaft 25 and a belt 39 extending between both pullets 38 and 26.

Water feed valves 40 and 41 are intergrated with each other such that they receive water through common water inlet connected to a commercial water supply and discharge water independently through their respective outlets. More specifically, the water feed valve 40 opens in the washing and rinsing operations of the machine to supply water into the outer tank 4, whereas, the water feed valve 41 opens during drying operation to supply cooling water to be sprayed into the duct 31. A flow regulator 42 connected to the outlet of the water feed valve 41 changes its water-flow cross-section in accordance with a change in the pressure of the water from the commercial water supply to maintain a constant flow rate of cooling water supplied into the duct 31.

A water absorber 43 is disposed in the duct 31 in order to enhance the efficiency of the heat exchange between the moistened water discharged from the drum and the cooling water. The water absorber 43 includes a plurality of tabular members made of a water-absorbing material and arranged to extend vertically in a mutually spaced relationship. The common inlet of the integrated water feed valves 40 and 41 is connected through a hose 44 to the commercial water supply (not shown). The outlet of the water feed valve 40 is connected through a flexible water filling hose 45 to the water-filling opening 45 of the outer tank 4. The flow regulator 42 is connected to the water sprayer 32 through a flexible tube 46 having a small diameter.

A shock absorber 47 includes a rod 47*a* and a damper 47*b* incorporating a coiled spring. There are four such shock absorbers 47 which suspend the outer tank 4 from four corners of the outer frame 1.

The afore-mentioned water level sensor 48 is capable of sensing the water level in the outer tank 4 in terms of the water head or pressure transmitted through the flexible small tube 34 from the trap 33. The water level sensor 48 produces, in accordance with the sensed water level, signals for turning on and off the water feed valve 40 so as to maintain the water in the outer tank 4 at a set level.

A series of operations from washing to drying is conducted in accordance with a program under the control of a control device 49 which is disposed under the control panel portion 2a.

The construction and operation of the speed reduction device 16 will be described with reference to FIG. 4.

The speed reduction device 16 comprises the clutch mechanism 17 and the reduction mechanism 18, as explained before.

The clutch mechanism 17 has a clutch 50 including a plurality of cylindrical sliders, coiled clutch springs each having a polygonal cross-section and wound on the sliders, and a clutch case 50a encasing the sliders and the clutch springs. The clutch mechanism 17 also includes the following parts: a ring spring 51 fitting on the outer periphery of the clutch case 50a and radially outwardly bent at its one end so as to form a hook 51a; a clutch solenoid 52 for driving a plunger 52a such that the plunger 52a is brought into and out of contact with the hook 51a of the ring spring 51 in response to turning off and on of the electrical power supplied to the solenoid 52; and a brake 53 for preventing the gear box 57 from rotating following the rotation of the output shaft 18b which is rotated at a speed reduced by the gear box 57. The brake 53 includes a brake disk 54 with a brake lining 54a fixed thereto, a frame cover 58a fixed to the gear box 57 and a brake pad 55 for clamping the brake disk 54 therebetween, and a plurality of coiled compression springs 56 for urging the brake pad 55.

Referring now to the reduction mechanism 18, an input shaft 18a has a pinion formed on one end thereof and received in the gear box 57, while the output shaft 18b has a wheel gear fixed to one end thereof and received in the gear box 57. As explained before, the pulley 22 is fixed to the output shaft 18b. The gear box 57 accommodates, in addition to the pinion and wheel gear on the ends of the input and output shafts 18a and 18b, an intermediate reduction gear train drivingly interconnecting the above-mentioned pinion and wheel gear. A hollow shaft 57a receiving and supporting the input shaft 18a and a box cover 57b receiving and supporting the output shaft 18b are integrally fixed to the gear box 57. Numeral 58 denotes a box frame covering the gear box 57.

The operation of the speed-changing device 16 having the described construction is as follows:

During a low-speed rotation of the drum, as in the washing, rinsing and drying operation, as well as in the initial stage of the dehydration operation, the clutch solenoid 52 causes the plunger 52a to contact with the hook 51a of the ring spring 51 so as to prevent rotation of the clutch case 50a, so that the clutch is set in disengaged position. Therefore, the torque input to the input shaft 18a is transmitted to the output shaft 18b through the reduction gear train in the gear box 57, so that the output shaft 18b is rotated at a reduced speed. Meanwhile, the rotation of the gear box 57 is prevented because the torque acting thereon is transmitted to the brake disk 54 through the hollow shaft 57a and the clutch 50.

During a high-speed rotation in the later stage of the dehydrating operation mode of the machine, the plunger 52a is disengaged from the hook 51a, so that the clutch is set in engaged position. In this state, the hollow shaft 57a is released from the brake 53, so that, the torque of the input shaft 18a causes the hollow shaft 57a to rotate through the action of the clutch 50, with the result that the output shaft 18b is rotated together with the clutch 50 and the gear box 57 at the same speed as the input shaft 18a.

A description will now be made of the system for controlling the operation of the described embodiment of the full-automatic washing and drying machine with reference to FIG. 5 which is a block circuit diagram of the embodiment and FIG. 6 which illustrates the program of the operations from washing to drying together with states of operation of the controller for executing the program.

Referring first to FIG. 5, the aforementioned control device 49 is includes a programmed controller 59, switches and so forth. The programmed controller 59 is composed of a microprocessor as a CPU (Central Processing Unit), memories including a ROM (Read Only Memory) and a RAM (Random Access Memory), and an interface for external supply and receipt of signals. The programmed controller 59 executes a program which will be described later with reference to FIG. 6.

In response to signals from the programmed controller 59, an amplifier circuit 60 operates a triac 62 through a resistor 61 so as to control the operation of the control components such as the motor 15. A power supply circuit 63 transforms an AC power to a lower voltage and rectifies the low-voltage AC power to a DC power which is supplied to components and switches in the control device 49, as well as to various sensors which will be mentioned later. A main switch 64 can be manually turned on and off. When a predetermined time has elapsed after completion of a selected program, an auto-off switch 65 operates to automatically turn off the main switch 64. A subordinate switch 66 is adapted to be automatically turned on by an auto-on relay which operates simultaneously with the turning-on of a later-mentioned input switch 68. The switch 66 is automatically turned off when a selected program is completed. The switch 66 also can be turned off by turning-off of a later-mentioned lid/unbalance switch 70. The above-mentioned input switch 68 is used to select and input one of the programs stored in the memory of the programmed controller 59, e.g., a process from washing to dehydration or a process from washing to drying. An indicator panel 69 is capable of indicating or displaying various data such as the state of the power supply, the kind of the selected program, progress of the process of the selected program, time, and so forth.

The lid-unbalance switch 70 mentioned before is set off when the lid 3 is opened and when the amplitude of vibration of the suspended outer tank caused during dehydration by a mass unbalance of the clothes in the outer tank has exceeded a predetermined limit value. This switch 70, when set off, turns off the auto-on relay 67 so as to turn off the subordinate switch 66. A drum position detector 71 such as a rotary encoder is disposed in the vicinity of the shaft portion 12 of the drum 7 so as to detect the rotational or angular position of the drum lid 11 to enable the indicator panel 69 to indicate the position of the drum lid 11 thus detected. A temperature sensor 72 is provided on the end wall 4b of the outer tank 5 opposing the sheath heater 29. The temperature sensor 72 senses the temperature of air around the heating chamber 27 and, upon sensing an extraordinarily high temperature above a set temperature, produces a signal for terminating the supply of the electrical power to the sheath heater 29. A humidity sensor 73, which is disposed in the vicinity of the suction opening 24c of the circulation fan 24, senses the humidity of the moistened air circulated during drying operation. When the sensed humidity has come down below a predetermined level indicative of completion of the drying, the humidity sensor 73 produces a signal for terminating the drying operation. Numeral 74 denotes a power supply plug.

The operation will be described with reference to FIG. 6.

After placing clothes A to be washed in the drum 7, the user closes the drum lid 11, the outer tank lid 6 and the lid 3. The user then turns on the main switch 64 of the control device 49, selects an operation program and then presses the button of an input switch 68 corresponding to the selected program. As a result, the auto-on relay 67 operates to turn on the subordinate switch 66, whereby the operation is commenced. When the water level in the outer tank 4 is still below a set level indicated at S in FIG. 3, the water level sensor 48 produces a signal for opening the water feed valve 40. The water level sensor 48, upon sensing the water level reaching the set level S, produces a signal for closing the water feed valve 40. At the same time, power is supplied to the motor 15. As explained before, the motor 15 repeats short-period cycles of forward and backward operation, and the torque of the motor output shaft is transmitted through the belt 21 to the input shaft 18*a* of the speed reduction device 16, the rotation of which is delivered from the output shaft 18*b* of the speed reduction device 16, with the speed reduced by the reduction gears in the gear box 57, and is transmitted to the drum 7 through the belt 23. Consequently, the drum 7 repeats reciprocatory rotational motions at a frequency of 10 to 30 cycles per minute, each cycle including 0.5 to 2.5 turns of forward rotation, 0.3 to 2.0 seconds of pause, 0.5 to 2.5 turns of backward rotation and 0.3 to 2.0 seconds of pause. During the rotation of the drum 7, the clothes A in the drum 7 are impacted and stirred by the lifters 8*a* provided on the inner peripheral surface of the drum 7. After a predetermined time period has elapsed, the motor 5 is stopped to cease the washing operation and then the rinsing operation is started.

The rinsing operation is commenced with a supply of electrical power to the solenoid of the draining valve 35 so that the draining valve 35 is opened to discharge the water used in the washing. Subsequently, low- and high-speed dehydration operations are sequentially executed to dehydrate the clothes A. Then, the outer drum 4 is refilled with water to the level S as in the case of the washing process described before, followed by reciprocatory motions of the motor 15 to repeat the operation predetermined times until the rinsing is finished.

The dehydration operation is then executed again. This operation is commenced with supply of power to the draining valve 35 so as to drain the outer tank 4 and the clothes A. Then, power is supplied to the motor 15. In the initial stage of the dehydration, the drum is rotated at a low speed of, for example, about 80 to 120 rpm, since the torque is transmitted through the reduction gear train in the gear box 57 of the reduction device 16. During this initial low-speed rotation of the drum 7, a part of the water contained in the clothes A is extracted and the clothes A are uniformly spread and distributed over the entire area of the inner peripheral surface of the cylindrical portion 8 of the drum 8 to minimize any excessive local concentration of the mass, thus avoiding generation of any unacceptably large peak of the load. Subsequently, the clutch solenoid 52 of the reduction device 16 is energized to release the clutch 50 from the brake 53 to form a torque-transmission path by-passing the reduction gears in the gear box 57. In this state, the output speed of the motor 15 is reduced only through the belt transmission mechanism including the pulleys 19 and 20 so that the drum 7 is rotated at a high speed of 600 to 1,100 rpm, thereby effecting centrifugal dehydration at high speed. Subsequently, the drum is repeatedly rotated in forward and backward directions in short periods, thus loosening the clothes A which have been attached to the inner surface of the drum 7 thereby allowing the clothes A to fall into the space in the drum.

The drying operation is then started with energizations of the solenoids of the water feed valve 41 and the draining valve 35, the fan motor 37, the motor 15 and the sheath heater 29. In consequence, the water feed valve 41 and the draining valve 35 are opened and the fan motor 37 starts to drive the impeller 24*a* of the circulation fan 24 in the direction of an arrow P shown in FIG. 2, while the motor 15 drives the drum 7 at a low speed and in a reciprocating manner as in the case of the washing operation, so that the clothes A in the drum 7 are stirred by the mechanical action of the lifters 8*a* and the reciprocatory motion of the drum 7. Meanwhile, the air discharged through the discharge opening 24*d* of the circulation fan 24 is heated by the sheath heater 29 in the heating chamber 27 so that hot air is blown into the drum 7 through the opening 27*a* of the heating chamber 27 past the small holes 9*b* formed in the peripheral wall of the recessed portion 9*a* of the drum end plate 9*a*. The heated air contacts the wet clothes to promote evaporation of the water content and the air moistened by the evaporated water content is discharged through the small ports 8*b* in the wall of the drum 7 and then through the small holes 10*b* into the outer tank 4, from which the moistened air is then introduced into the duct 31 past the draining opening 4*e* and the draining chamber 30. Meanwhile, cooling water (commercial running water) is supplied to the sprayer 32 in the duct 31 through the water feed valve 41 and the flow regulator 42 at a rate of, for example, 0.2 to 0.4 liter per min. The water is then sprayed in the form of a shower or atomized mist as indicated by D. The shower or mist D of water then falls along the duct 31 onto the water absorbing member 43 to wet the latter. The moistened air introduced into the duct 31 then contacts with the water flowing on and contained in the water-absorbing member 43 and the shower or mist falling through the duct 31 and thus is cooled by the water, so that the water initially contained in the moistened air is condensed into liquid phase. As a result, the absolute humidity of the air is reduced and the thus dried air is then sucked and discharged by the circulation fan 24 so as to be forced into the drum 7 after heated by the sheath heater 29. Thus, the clothes A are dried by the air which is circulated through the drum 7 while being heated and dehumidified. The cooling water together with the water liquefied from the moisture content of the air is discharged to the outside of the machine through the draining valve 35. The supply of the electrical power to the sheath heater 29 is terminated to cease the drying operation when a predetermined time period has elapsed after the start of the drying operation, or when the humidity of the moistened air sensed by the humidity sensor 73 at the suction opening 24*c* of the circulation fan 24 has reached a predetermined level indicative of completion of the drying. Subsequently, air is circulated through the drum 7 without operation of the heater so as to further dry the clothes and to cool the clothes and the machine with cold air for a predetermined time period, thus completing the drying operation. Preferably, the drying with the cold air is conducted with the water feed valve 41 opened intermittently or kept closed so as to allow the clothes A and the machine to be cooled by natural heat radiation.

In the described embodiment, the drum 7 is designed to have a comparatively small diameter for the purpose of reducing the size of the machine, in particular height and depth, and for the purpose of reducing vibration and noise generated during dehydrating operation of the machine. Nevertheless, an ample internal volume of the drum 7 is provided since the cylindrical portion of the drum 7 has a large axial dimension relative to its diameter.

In this embodiment, the drum is repeatedly and reciprocatingly rotated in one and the other directions for a very short period in each direction, so that a large mechanical impact is imparted to the clothes A by the lifters 8*a* on the inner peripheral surface of the drum 7, with a result that a cleaning effect is substantially equivalent to those of other types of washing machines such as volute-type and stirring-type machines.

The cleaning performance of the described embodiment of washing and drying machine will be explained with reference to FIGS. 7 and 8.

Figure 7:
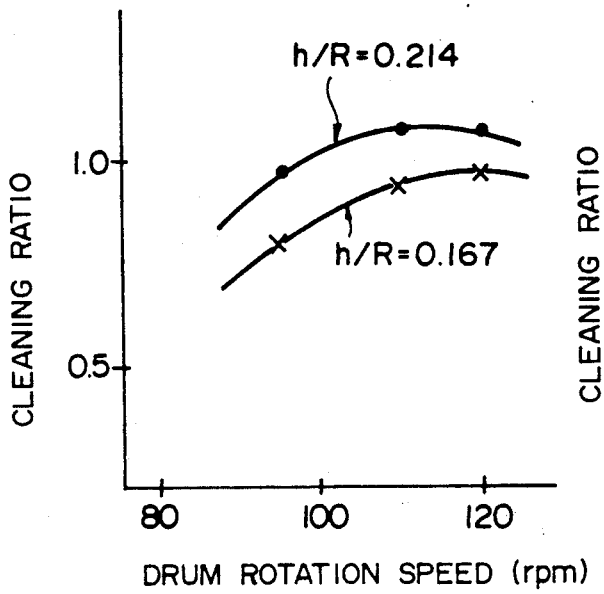
FIG. 7 is a graph showing the relationship between the speed of rotation of a drum shown in FIGS. 1 to 3 and a cleaning ratio.

FIG. 7 shows the results of a test conducted in which a rated quantity of clothes was washed in a drum of 420 mm diameter for a predetermined time and the relationship between the rotational speed of the drum 7 and a cleaning ratio was determined. The test was conducted with a variety of heights of the lifters 8. The test results are shown by using the ratio h/R of the lifter height h to the drum radius R as a parameter. It is impossible to definitely determine the rotational speed of the drum 7 during washing, since the drum reciprocatingly rotates in one and the other directions at short periods. Therefore, the steady rotation speed of the drum 7 in the low speed dehydration mode in which the drum is driven at low speed through the reduction mechanism 18 as in the case of the washing operation was plotted as the drum rotation speed during washing. The term cleaning ratio is used in this specification to mean the ratio of the cleaning effect determined through the test to a predetermined desirable value of the cleaning effect. It will be seen that the desirable value of the cleaning effect is obtained when the drum rotation speed falls in a range between 100 and 120 rpm.

Figure 8:
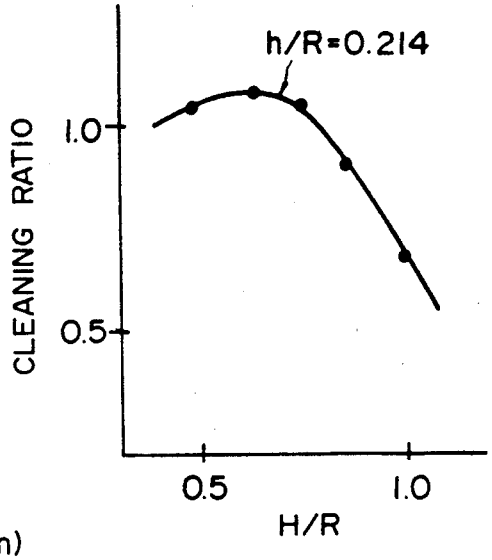
FIG. 8 is a graph showing the relationship between the water level H (see FIG. 3) in the drum 7 and the cleaning ratio.

FIG. 8 shows how the above-mentioned cleaning ratio changes in relation to a change in the ratio H/R of the water level H shown in FIG. 3 to the radius R of the drum 7, as observed when the drum 7 used in the test explained in connection with FIG. 7 was driven at 110 rpm. It will be seen that the desirable cleaning ratio is obtained when the ratio H/R ranges between 0.5 and 0.75. The cleaning ratio decreases as the water level H approaches the center of the drum 7. This is because the imparted by the lifters 8*a* is weakened due to the fact that the clothes are allowed to move more freely in the washing water. A similar tendency of reduction in the cleaning ratio is observed even when the ratio H/R falls between 0.5 and 0.75 when foaming of the detergent is vigorous. In order to avoid any reduction of the cleaning ratio due to foaming of the detergent, it is an effective measure to provide time intervals of drum rotation such that the drum is reciprocatingly rotated in the described member for 20 seconds, kept stationary for a time interval of 10 seconds and then reciprocatingly driven again for 20 seconds followed by the next interval of 10 seconds. Foams are partly extinguished during the period of the interval.

In the described embodiment, the drum 7 has a comparatively small diameter as explained before. The reduced drum diameter enables a more uniform distribution of clothes A during the low-speed dehydration, so that local concentration of mass and peaking in the load during rotation are suppressed to reduce noise and vibration during the high-speed dehydration. The effect of reduction in the diameter of the drum 7 will be described with reference to FIG. 9.

Figure 9:
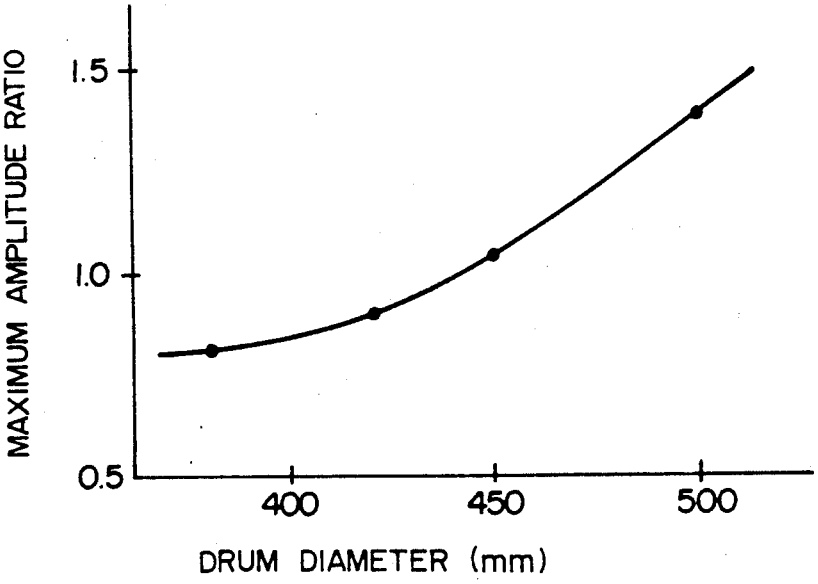
FIG. 9 is a graph showing the relationship between the diameter of the drum and the amplitude of vibration during dehydration.

A test was conducted by employing a plurality of drums of different diameters but having the same internal volume in order to examine how the vibration amplitude of the drum varies according to a change in the drum diameter. In this test, each drum was charged with clothes of an amount which is ½ the rated amount and which is understood to be liable to cause a mass unbalance in the drum. Each drum was rotated at 110 rpm for low-speed dehydration and the amplitudes of vibration were measured. FIG. 9 shows the relationship between the drum diameter and the maximum amplitude ratio which is the ratio of the maximum value of the measured amplitudes to a predetermined allowable amplitude. From this FIGURE, it will be understood that the amplitude of vibration during low-speed dehydration can be remarkably reduced by reducing the drum diameter while increasing the drum axial length for a given internal volume of the drum.

Figure 6:
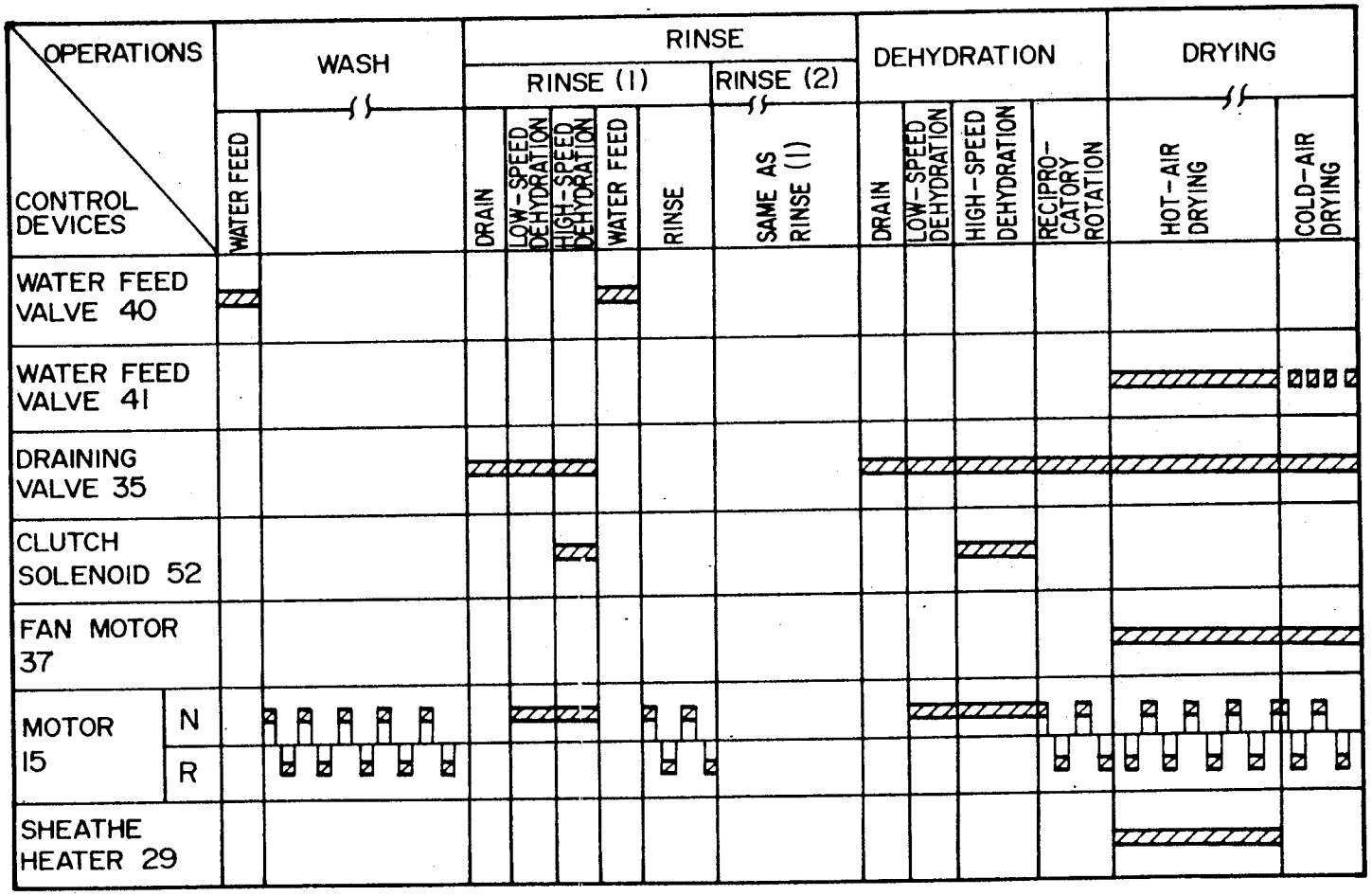
FIG. 6 is a time chart illustrative of the operation of the full-automatic washing and drying machine shown in FIGS. 1 to 5.

In the time chart shown in FIG. 6, repeated reciprocatory rotation of the drum 7 is not conducted during draining. The invention, however, does not exclude such a repeated reciprocatory rotation of the drum in the draining operation. Such a motion effectively loosens the clothes which have been entangled during washing, so as to facilitate uniform distribution of the mass of the clothes over the entire inner peripheral surface of the drum 7. Thus, repeated reciprocatory rotation of the drum during draining produces a remarkable effect in suppressing the vibration.

During drying, the air heated by the sheath heater 29 is blown into the lower half part of the drum 7 without externally leaking from a region around the opening 27*a* of the heating chamber 27. Therefore, substantially all part of the hot air is brought into contact with the clothes A. In other words, substantially no part of the hot air flows through the drum 7 without contacting the clothes A. In addition, since the heating chamber 27 is placed in the vicinity of the drum 7, any loss of heat due to radiation is reduced to improve the drying performance. Furthermore, dehumidifying performance is improved by the spray of the cooling water which effects cooling condensation of the moisture content of the moistened air so as to reduce the humidity of the air. It is also to be pointed out that the through-flow type fan, though its diameter is large, enables the machine to have a compact construction and offers a large flow rate of circulated air. The large air flow rate in turn makes it possible to maintain the temperature of the hot air below an allowable upper limit temperature level, thus eliminating problems such as discoloration of the clothes A.

The present invention also offers advantages in regard to the drive unit. Namely, the load and vibration are remarkably suppressed due to the use of the drum having a reduced diameter and due to the low-speed dehydration which is conducted prior to the high-speed dehydration. The drive unit for driving the drum 7 is composed of the 4-pole capacitance-type induction motor 15, the speed reduction device 16 having the clutch mechanism 17, and the belt transmission mechanism. It is, therefore, possible to switch, simply by operating the clutch mechanism 17, the driving operation between the repeated reciprocatory rotation mode employed in the washing and drying operations and the low- and high-s-eed rotation mode employed in the dehydration operation. This eliminates the necessity for the use of expensive speed-changeable motor. Furthermore, the speed reduction device 16 is capable of reducing the speed of rotation derived from the output shaft of the motor 15 and, during the high-speed dehydrating operation, the speed reduction device 16 rotates as a unit so that wear of gears incorporated in the clutch mechanism 17 and the reduction mechanism 18, as well as generation of noise by these gears, can be suppressed.

A compact design of the washing and drying machine is attained by the use of the following arrangements: Firstly, the size of the machine is reduced in the direction of diameter of the drum due to the use of the drum 7 having a reduced diameter and an increased axial length. The circulation fan 24, which is a through-flow type fan having an impeller 24*a* driven by a belt 39 and having substantially coplanar suction and discharge ports 24*c* and 24*d*, also contributes to a reduction in the size of the machine, when combined with the arrangement for spraying cooling water into the duct 31 which rises from the draining chamber 30. Thus, the washing and drying machine of the present invention can have a compact design which occupies substantially the same installation space as that of any of the known twin-drum type machines.

Although the invention has been described through specific terms, it is to be understood that the described embodiment is only illustrative and various changes and modifications may be made thereto.

For instance, it is possible to provide projections or friction members on the inner peripheral surface of the drum 7 and/or the inner surfaces of the end plates 9 and 10 so that the washing effect is enhanced. It is also possible to replace the first belt transmission mechanism of the drive unit with a gear type reduction means which may be incorporated in the motor 15 so as to reduce the size of the drive unit. Furthermore, versions of the machine having different washing and drying capacities can easily be designed and produced simply by changing the axial length of the drum, thus allowing common use of major component parts, contributing to a reduction in the cost.

What is claimed is:

1. A full-automatic washing and drying machine which automatically executes at least washing, dehydration and drying, comprising:

a machine frame;

an outer tank supported by said machine frame;

vibration damping means disposed between said machine frame and said outer tank so as to damp vibration of said machine frame;

a drum mounted in said outer tank for rotation about a substantially horizontal axis and accommodating an object to be washed, dehydrated and dried during washing, dehydration and drying, said drum having a cylindrical portion provided with an entrance opening which can be closed, end walls closing both axial ends of said cylindrical portion and at least one drum axle fixed to one of said end walls and arranged coaxially with said substantially horizontal axis, said drum axle being rotatably supported by said outer tank;

a reversible motor operable at a fixed speed;

power transmission means for transmitting the torque of said motor to said drum axle, said power transmission means including a speed-changing means having an input shaft driven by said motor and an output shaft drivingly connected to said drum axle;

control means for controlling said motor and said speed-changing means such that, during washing and drying operations, the direction of rotation of an output shaft of said motor is cyclically switched in short periods while said speed-changing means transmit the rotation of said output shaft of said motor to said drum axle at a reduced speed, whereas, during a dehydration operation, said motor operates unidirectionally and said speed-changing means transmit the unidirectional rotation of the motor output shaft with a speed reduction in an initial stage of said dehydration operation and, without speed reduction in a later stage of said dehydration operation;

water feeding means for supplying water at least into the interior of said drum prior to the washing operation;

draining means for draining the interior of said drum during dehydration operation; and drying means including hot air supplying means for supplying hot air into said drum during the drying operation.

2. A full-automatic washing and drying machine according to claim 1, wherein said power transmission means include first belt transmission means for drivingly connecting said input shaft of said speed-changing means to said motor output shaft, and second belt transmission means for drivingly connecting said output shaft of said speed-changing means to said drum axle.

3. A full-automatic washing and drying machine according to claim 2, wherein said motor is a 4-pole capacitance type induction motor.

4. A full-automatic washing and drying machine according to claim 3, further comprising lifters provided on the inner peripheral surface of said drum and projecting radially inwardly therefrom, and water level control means for controlling the amount of washing water during washing operation to a level below said substantially horizontal axis.

5. A full-automatic washing and drying machine according to claim 4, wherein said control means is arranged such that, during the washing operation, said drum performs repeated reciprocatory rotational operation at a frequency of 10 to 30 cycles per minute, each cycle including 0.5 to 2.5 turns of forward rotation, 0.3 to 2.0 seconds of pause, 0.5 to 2.5 turns of backward rotation and 0.3 to 2.0 seconds of pause.

6. A full-automatic washing and drying machine according to claim 4, wherein, during the draining operation, said drum performs a reciprocatory rotational operation similar to that in the washing operation.

7. A full-automatic washing and drying machine according to claim 1, wherein said draining means include a passage formed between said drum and said outer tank and communicating with the interior of said drum through communication apertures formed in both end walls of said drum, and wherein said hot air supplying means include a heating chamber adjacent one of said end walls of said drum, a heater disposed in said heating chamber, air blowing means for forcing air into said drum through said heating chamber, and a duct through which said passage is communicated with said air blowing means.

8. A full-automatic washing and drying machine according to claim 1, wherein said drying means further includes dehumidifying means for removing water from the air to be returned to said air blowing means.

9. A full-automatic washing and drying machine according to claim 8, wherein said dehumidifying means include spraying means for spraying cooling water into said duct.

10. A full-automatic washing and drying machine which automatically executes at least washing, dehydration and drying, comprising:

a machine frame;

an outer tank supported by said machine frame for movement relative to said machine frame within a predetermined limited range;

a drum mounted in said outer tank for rotation about a substantially horizontal axis and accommodating an object to be washed, dehydrated and dried during washing, dehydration and drying, said drum having a cylindrical portion provided with an entrance opening which can be closed and end walls closing both axial ends of said cylindrical portion;

driving means for driving said drum at a variable speed such that, during washing and drying operations, the direction of rotation of said drum is switched in short periods, whereas, during dehydration operation, said drum is driven at a low speed in an initial stage of said dehydration operation and at a high speed in the remainder of the dehydration operation;

water feeding means for supplying water at least into the interior of said drum prior to the washing operation;

draining means for draining the interior of said drum during dehydration operation; and drying means including hot air supplying means for supplying hot air into said drum during drying operation;

said draining means including a bottom space defined between said drum and at least a bottom of said outer tank, and communication means for providing communication between said bottom space and the interior of said drum;

said hot air supplying means including a closed air circulation loop including the interior of said drum, said bottom space and said communication means, a heater disposed in said closed loop upstream of the interior of said drum, a fan disposed in said closed loop and for supplying air to said heater, and a duct providing a communication between said bottom space and said fan;

said drying means including means for spraying cooling water into said duct in at least a part of the drying operation.

11. A full-automatic washing and drying apparatus according to claim 10, wherein said closed air circulation loop includes a heating chamber disposed adjacent one of said end walls of said drum and communicating with the interior of said drum, said heating chamber accommodating a heater, said fan being attached to said outer tank at a position adjacent said heating chamber.

12. A full-automatic washing and drying apparatus according to claim 10, wherein a recess communicating with the interior of said drum is formed in a central portion of the outer surface of the end wall of said drum adjacent said fan, said heating chamber being disposed between said recess and the portion of the wall of said outer tank opposing said recess, said fan being secured to said wall of said outer tank.

13. A full-automatic washing and drying apparatus according to claim 12, wherein said fan is a flattened through-flow fan.

14. A full-automatic washing and drying apparatus according to claim 10, wherein said fan is operated to circulate air through said closed loop even after said heater is de-energized in said drying operation.

15. A full-automatic washing and drying apparatus according to claim 10, wherein, even after said heater is de-energized in said drying operation, said fan is operated to circulate air through said closed loop and said spraying means is operated to spray the cooling water into said duct.

* * * * *